US006878102B1

(12) United States Patent
Commisso

(10) Patent No.: US 6,878,102 B1
(45) Date of Patent: Apr. 12, 2005

(54) LEG-ANKLE-FOOT EXERCISE ASSEMBLY

(76) Inventor: Luis Alberto Commisso, 11571 Villa Grand, #622, Fort Myers, FL (US) 33913

( * ) Notice: Subject to any disclaimer, the term of this patent is extended or adjusted under 35 U.S.C. 154(b) by 173 days.

(21) Appl. No.: 09/934,319

(22) Filed: Aug. 21, 2001

(51) Int. Cl.[7] ..... A63B 21/02

(52) U.S. Cl. ..... 482/79; 482/80; 482/146; 482/147

(58) Field of Search ..... 482/79, 80, 146, 482/147, 1–10

(56) References Cited

U.S. PATENT DOCUMENTS 3,020,046 A * 2/1962 Hotas
4,306,714 A 12/1981 Loomis et al.
4,337,939 A * 7/1982 Hoyle et al.
4,355,801 A 10/1982 Thomsen
4,452,447 A 6/1984 Lepley et al.
4,650,183 A * 3/1987 McIntyre
4,700,943 A 10/1987 Widinski et al.
4,703,928 A * 11/1987 Escher
5,169,364 A 12/1992 Donaldson
5,186,698 A 2/1993 Mason et al.
5,413,543 A 5/1995 Drago
5,645,516 A 7/1997 Foster
5,853,354 A 12/1998 Kubota
5,902,214 A * 5/1999 Makikawa et al.

* cited by examiner

*Primary Examiner*—Jerome Donnelly
(74) *Attorney, Agent, or Firm*—Malloy & Malloy, P.A.

(57) ABSTRACT

An exercise assembly structured to direct the foot-ankle-leg, knee, etc. and associated portions of a person's body through a plurality of different paths of movement, wherein each path of movement comprises an at least partially different configuration such that exercise resulting from the various movements will be concentrated on predetermined portions of the body being exercised. The platform is suspended by a support assembly interconnected to a base and is preferably, but not exclusively, directed through the aforementioned paths of movement manually by the user. A sensor assembly including a processor may determine and store selected movements of the platform for graphical or other visual display to the user and for programmed duplication of the sensed paths movement when desired. A weight assembly including at least one but preferably a plurality of different weights are interconnected to the platform and extend outwardly therefrom to provide additional resistive forces to the user's foot, ankle, and leg as they are exercised.

7 Claims, 4 Drawing Sheets

40
44
46
46
10
72
14
22'
22
20
12
24
26
36
30
16
34
38
18

Fig 2
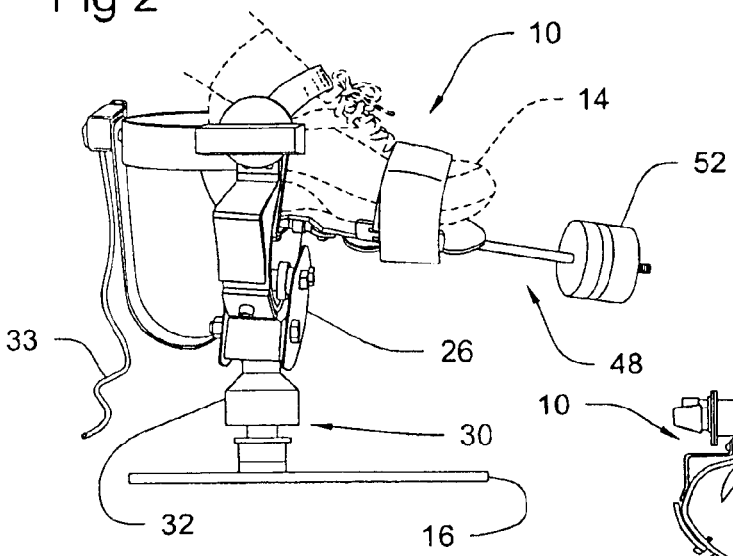
Fig 3
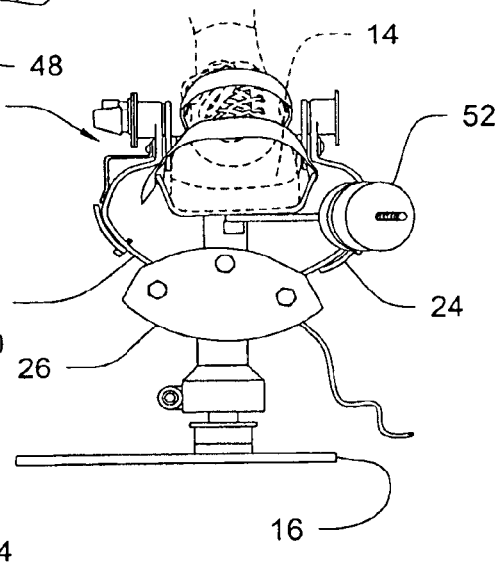
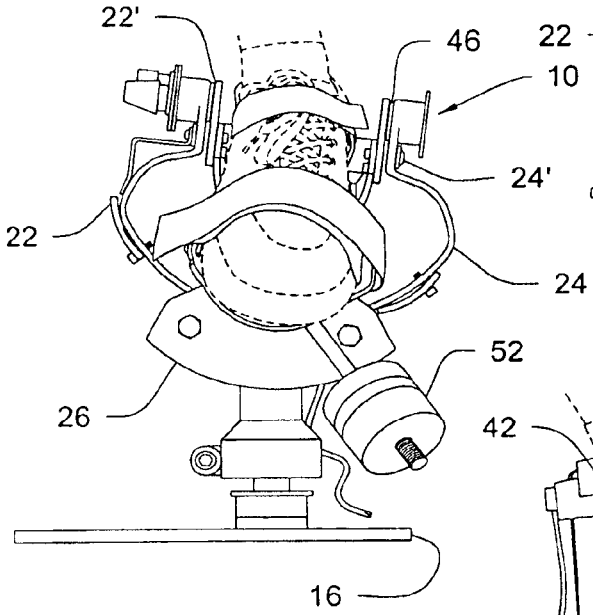
Fig 4
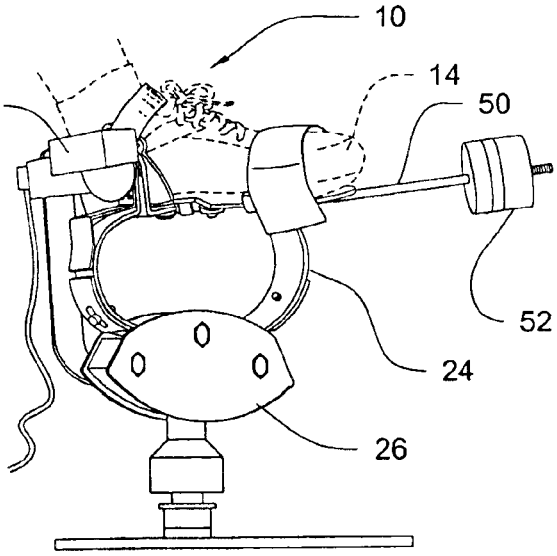
Fig 5

LEG-ANKLE-FOOT EXERCISE ASSEMBLY

BACKGROUND OF THE INVENTION

1. Field of the Invention

This invention relates to an assembly structured to strengthen, rehabilitate and/or generally exercise predetermined portions of the user's body including the ankle, foot, leg, knee and associated portions thereof, through the provision of a platform, to which the user's foot is secured, and wherein the platform is configured to rotate or otherwise move, concurrently or independently through any one of a plurality of paths of movement including three orthogonal axes of rotation, dependent on which predetermined portion of the user's body the exercise is intended to be concentrated.

2. Description of the Related Art

In recent years there is been an ever increasing tendency for the general population to follow a healthier life style in an effort to improve a person's general well being and also to improve ones appearance. Such an improved life style frequently incorporates a low fat diet in addition to an increased amount of physical activity in the form of exercise. In typical fashion, an exercise regiment undertaken by most individuals who are concerned with their overall well being, includes cardiovascular type exercises. In addition, many individuals are concerned with the development of specific muscle groups or areas of the body, which require rehabilitation or where fat deposits have collected. In order to perform the required exercises in a more efficient and convenient manner, different types of exercise equipment have been developed. Such equipment is typically designed to facilitate the performance of specific exercises which concentrate on predetermined areas of the body, dependent on which portion of the body or specific muscle group a person wishes to develop.

Numerous exercise assemblies of somewhat conventional design are known and commercially available and typically include springs, flexible material bands, weights and/or elastic resistance elements. Such conventional resistance structures are normally connected to a plurality of different attachment members and/or platforms designed to support or otherwise engage the user of the apparatus in a predetermined, intended manner. In addition, known or conventional exercise assemblies are often designed and structured to allow the performance of one or more exercises in a manner which hopefully provides the most benefits to the muscle groupings or other portions of a user's body which require strengthening, rehabilitation or general exercise. In addition to the above, as part of certain known or conventional exercise assemblies, utilization of substantially large and somewhat fixed apparatus is sometimes required. Such apparatus, while generally not being motorized, frequently includes relatively complicated or sophisticated structural components, which are designed and structured to facilitate performance of a specific exercise or movement of the body. Conventionally, large or more permanent type of apparatus usually includes some type of support platform having sufficient structural integrity to support at least a portion, if not all, of the user's weight so as to orient the user in a position which facilitates manipulation of a predetermined resistance assembly.

The industry associated with the design and manufacture of exercise equipment has made certain concerted efforts to develop a wide variety of apparatus and/or equipment in an effort to satisfy the various segments of the consuming public concerned with the development of different portions of the body. Such "specialized" equipment varies significantly, at least from a structural standpoint, since the exercise intended to be performed is designed to be concentrated on a specific area of the user's body.

By way of example, there are currently in use many devices designed specifically for the exercise of the lower leg, including the foot, ankle, and associated muscle groups or joint portions of the user's body. Typically, such devices are portable in nature and include some form of pulling force or stress being applied to the foot, ankle or leg portion by the user, either by manually applying such forces or utilizing some type of related resistance device, such as the types discussed above. Other known or conventionally structured exercise devices, which are particularly aimed at the exercise or strengthening of the lower leg, ankle, foot, etc., may incorporate more mechanized features which concentrate the application of resistance forces to more specific areas of this portion of the user's body. It can be appreciated that devices specifically designed to rehabilitate, strengthen or generally exercise the lower leg portions of an individual's body, as outlined in more detail above, may assume a wide variety of other structural configurations. This is at least partially due to the fact that the human foot is capable of a wide range of motion because of the unique structure of the human ankle joint, foot and lower leg. The primary motion provided by the ankle joint is dorsal and plantar flexion. In performing plantar flexion, the foot is rotated about the ankle joint in a manner which moves the toes downward, below the ankle. This is accomplished when a person stands on their toes. In a dorsal flexion the foot is pivoted about the ankle joint to draw the toes upward above the heel. The ankle joint also permits limited motion in inversion and eversion. In inversion, the soles of both feet move towards each other as when both feet are inverted simultaneously. In addition the foot and ankle joint may be rotated about an axes extending about the ankle joint and heel by action of the tibia and fibula, which are the bones forming the lower leg.

Due to the obvious versatility in the range of motion, it can be appreciated that proper exercise directed towards the lower leg, ankle, foot, knee, etc. could best be accomplished by an improved exercise assembly, which is capable of directing the foot, preferably under the application resistive force through a plurality of different movements which may include some or all of the three orthogonal axis of rotation (x, y & z). Each such movement would preferably vary, at least to the extent of concentrating forces or stresses, resulting from the motion of the foot, on the predetermined joints, muscle groupings or associated portions of the area of the user's body, which require exercise, strengthening or rehabilitation.

To date none of the conventional known and relatively unsophisticated exercise devices are capable of performing beneficial exercises in an effective and efficient manner and with sufficient versatility such that various ones of the different muscle groupings, joints, or related portions, etc., may be specifically targeted.

SUMMARY OF THE INVENTION

This invention is directed towards an assembly structured to exercise predetermined portions of the user's body, including the leg, ankle and foot portions, as well as the joints, muscle groupings and other parts of a person's body associated therewith. The structural and operative features of the exercise assembly of the present invention allow for the strengthening, rehabilitation and/or general exercise of intended body portions, by directing the foot, ankle and lower leg through different motions or "paths of movement", each of which has an at least partially different configuration, dependent on the specific area or part of the user's body on which the exercise is to be concentrated. More specifically, the paths of movement, set forth above, include but are not necessarily limited to the conventional orthogonal axis of rotation comprising the x axis, y axis and z axis. Further, the range of movement of the platform is deliberately set to extend beyond the "normal" range of movement of a particular joint in order that the joint or portion of the foot, ankle, leg, knee, etc. on which the exercise is concentrated, may be additionally expanded or a corresponding portion of the user's body may be additionally strengthened to increase his ability to perform functions or movements involved in ones activities, including sports, exercise, work, etc.

More specifically, the exercise assembly of the present invention comprises a base generally in the form of a supporting plate or like structure which may be removably positioned on a horizontal supporting surface or otherwise mounted on a track like structure, again dependent on the specific application of the exercise assembly. The platform is movably attached in supported relation on the base by means of a support assembly. The platform is dimensioned and configured to receive, and at least partially support, at least one foot of a user of the subject exercise assembly. The support assembly preferably includes at least one support structure capable of supporting the platform thereon in outwardly and/or upwardly disposed, substantially suspended relation to the base. More specifically, the support structure preferably comprises a one piece structure having a semi-circular configuration formed of a steel or like material which may or may not be at least partially flexible, but which is disposed and structured such that its free ends engage the platform and a mid portion of the curvilinear length of the semi-circular configuration is secured to the base so as to universally move therewith through the various axes of rotation, as set forth above. The disposition and configuration of the support member or structure facilitates its alignment in corresponding relation to the transverse axis and rotational anti-lateral axis corresponding to the movements of the ankle. The curvilinear or semi-circular configuration of the support structure is such that its diameter corresponds to or aligns with the true center of articulation of the ankle joint. In further descriptive terms, the diameter of the semi-circular configuration of the support member crosses through or co-extends with the rotational or bending movement or extension of the ankle during its various positions of rotation. The support structure allows the versatility of movement, as set forth above, due at least in part to its configuration and its placement in the frontal plane, thereby allowing movement both clockwise and counter clockwise in a horizontal plane of rotation. Further, the diameter of the semi-circular support structure is disposed to co-extend with the anti-posterior axis of the ankle. In addition, the support structure can be rotated in the horizontal plane, as set forth above, which permits the movement of rotation of the knee and ankle along the longitudinal axis of the lower leg portion. This allows the determination of the initial position of the angular relation of the thigh to the leg as well as the leg to the ankle and the programing or re-establishment of such movements or positions relative to one another, as will be described in greater detail hereinafter. Accordingly, the support structure of the support assembly allows the user to exert certain forces or pressures directly on the platform as the foot, ankle, knee and lower leg are directed to travel through any one of the aforementioned plurality of paths of movement and/or about the various axes of rotation. At the same time, the support assembly is cooperatively structured with other components of the exercise assembly to provide a beneficial amount of resistance to the forced travel of the platform, in order to further strengthen or otherwise rehabilitate the muscles, joints, etc. associated with the lower leg, ankle, and foot.

In at least one preferred embodiment of the present invention, motive force applied to the platform is accomplished by movements and forces applied to the platform by the user, rather than by any exterior motor or driver. In doing so the user places his or her foot on the platform and, dependent upon the joint or portion of the user's body to be exercised and/or strengthened, the user moves the platform through predetermined or prescribed path of movement which may include one or more of the aforementioned three axes of rotation. Range of movement is also determined by the user. However, as set forth above, the range of movement of the exercise assembly of the present invention is such that the user may force the one or more joints being exercised to be extended beyond the "normal" range or ranges of movement with the associated joint or joints in order to deliberately increase such range of movement for a given joint or joints and/or to additionally strengthen the joint. The various joints are thereby allowed to exceed what may be considered a normal range of movement or endure increased stress on a specific joint or portion of the user's body.

In accomplishing such movements along the aforementioned prescribed paths of travel a certain amount of predetermined resistance, tension or stress may be placed on the platform, and accordingly the portion of the user's body being exercised, through the provision of at least one but in certain embodiments a plurality of weights attached to the platform. As will also be described in greater detail hereinafter, the one or more weights may include an elongated mounting or connecting arm and one or more weight members attached to an outer most end thereof. The actual weight members are disposed laterally outward in anyone of a variety of angular orientations from the platform. The plurality of weights, including the corresponding connecting arms and weight members which are fixed to the platform positions are at least partially determined by the various movements or paths which the user forces the platform, during the exercise procedure.

In addition to the above, interconnected mechanical linkage associated with the base and/or the support assembly allows movement of the platform, under the control of the user, relative to the base through what may be broadly or generally defined as a "universal" range of motion, which includes but is not limited to the three orthogonally disposed axes of rotation, as set forth above.

It should be further noted that in yet another embodiment of the present invention, at least one but preferably a plurality of individual drive motors, which may be electrically powered, may also be interconnected and define what may generally be termed as a driv a drive assOUMovement of the platform is thereby facilitated and controlled, with the users foot attached thereto, through a predetermined or prescribed path of movements, again dependent upon the portions of the users body intended to be exercised or strengthened. In such an embodiment three individual electric motors may be utilized, each motor being associated with the three orthogonal axes of rotation. A "universal" range of motion through which the platform and the foot of user may pass is thereby facilitated. The three drive motors may further be structured to vary or more specifically extend the range of motion of any or all of the joints or body portions associated with the knee, ankle, foot, etc.

The exercise assembly of the present invention further comprises a sensor assembly which, in at least one embodiment, includes a plurality of sensors, each interconnected to the platform and/or support assembly and cooperatively structured therewith to determine movement of the platform relative to a different one of a plurality of predetermined axes of rotation which, for purposes of clarity, may be considered reference axes, collectively oriented in an orthogonal relation to one another. The plurality of sensors are concurrently operative and, as set forth above, cooperatively structured to sense movement of the platform through the aforementioned substantially universal range of motion. The sensors may be incorporated for use with a processor and/or computer assembly for processing the sensed data and storing the data so that is able to accessed and used to program a plurality of "duplicate" movements of the platform, with the users foot mounted thereon, for subsequent use. Also the processor and computer assembly may incorporate some type of graphical, video or other type of display which allows the user to view the pattern of movements as well as the range of movements of the prescribed exercise procedure on a real time basis.

Therefore, the exercise assembly of the present invention provides a versatile, reliable and precisely adjustable means of exercising the predetermined portions of an individual's body including the leg, ankle and foot portion, as well as the muscle groupings, joints, etc. associated therewith. The strengthening rehabilitation and/or general exercising of these predetermined portions of the user's body is thereby efficiently accomplished.

These and other features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 2 is a side perspective view of the embodiment of FIG. 1;

FIG. 3 is a front perspective view of the embodiment of FIG. 1;

FIG. 4 is a top perspective view of the embodiment of FIG. 1;

FIG. 5 is a lower, side perspective view of the embodiment of FIG. 1.

Like reference numerals refer to like parts throughout the several views of the drawings.

DETAILED DESCRIPTION OF THE PREFERRED EMBODIMENT

The present invention is directed towards an assembly structured to exercise predetermined portions of a user's body which includes the lower leg, ankle and foot, as well as parts of the body associated therewith, including related muscles, joints, etc. In performing such exercise, a foot, and as a result, the ankle and lower leg, are directed through at least one but preferably a plurality of different movements. For purposes of clarity the individual movements through which the indicated body portions are forced to travel will herein be termed "paths of movement". Such terminology is believed to be appropriate since the movements through which the predetermined body portions are directed include specifically configured paths, which serve to rotate the foot and ankle joint, as well as the knee, lower leg, thigh, etc. relative to a plurality of axes of rotation. Also, by way of explanation the referred to axes of rotation may be relatively disposed in an orthogonal relation to one another so as to be more specifically defined as a typical x, y, z, set of axes.

Figure 1:
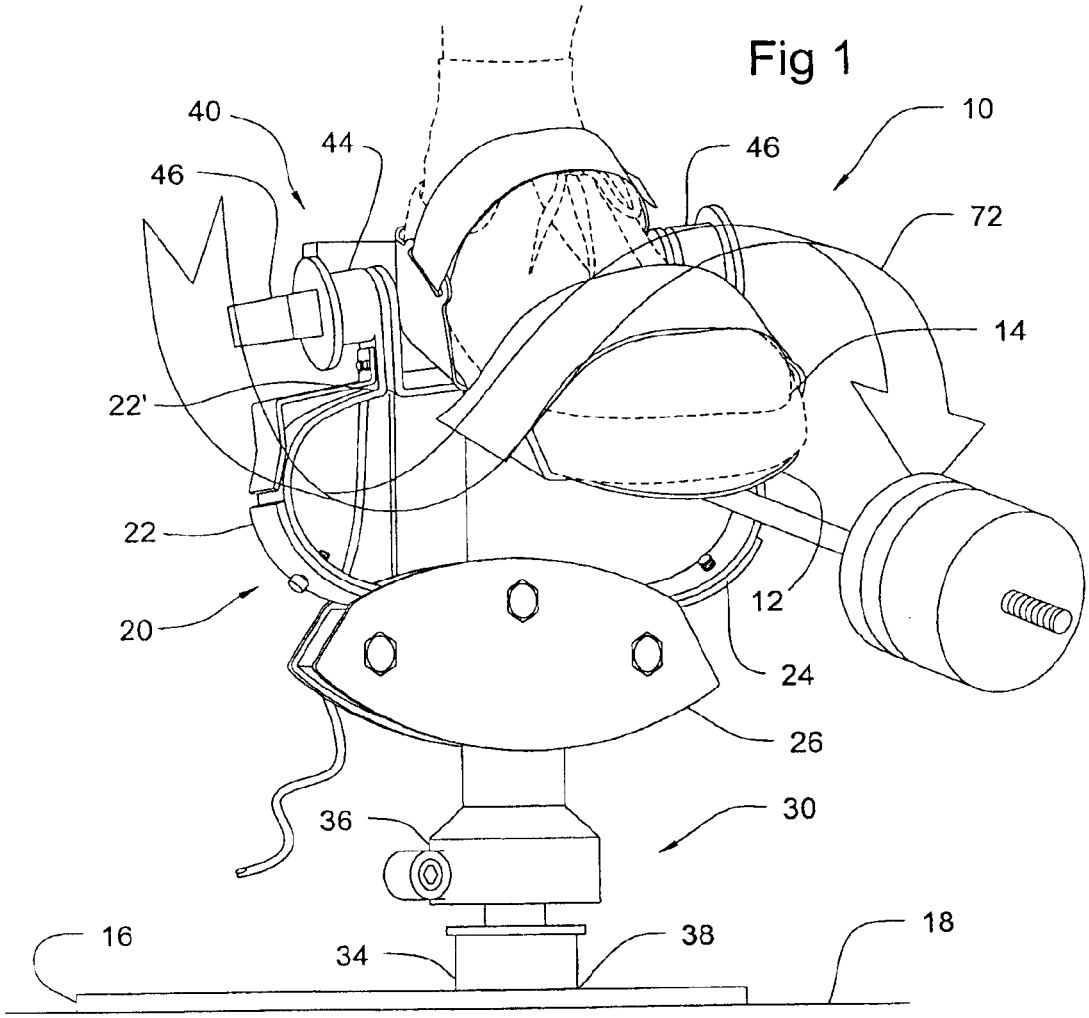
FIG. 1 is a perspective view of the exercise assembly of the present invention including a schematic directional arrow representative of at least one path of movement, capable of being performed by the subject exercise assembly.
Figure 6:
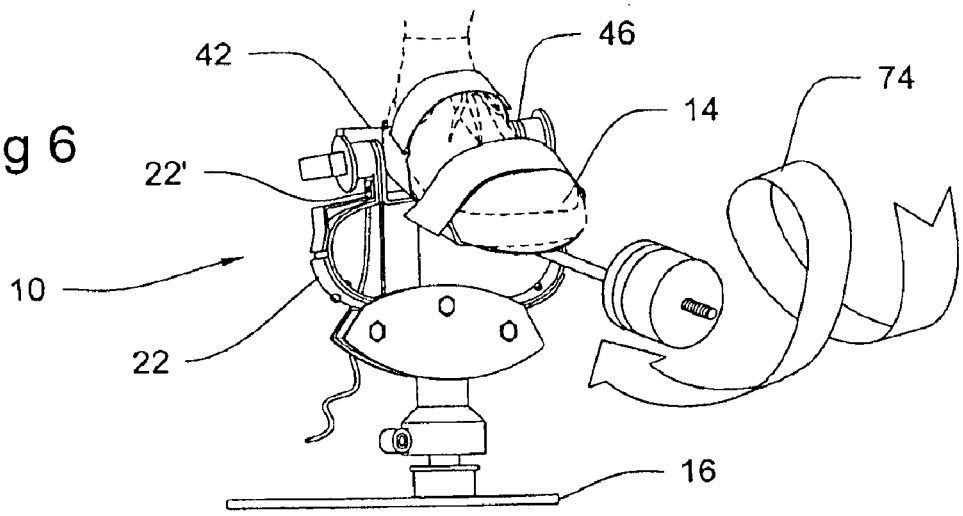
FIGS. 6, 7 and 8 are schematic representations, including directional arrows of some of the plurality of different paths of movement which may be performed by the exercise assembly of the present invention.
Figure 7:
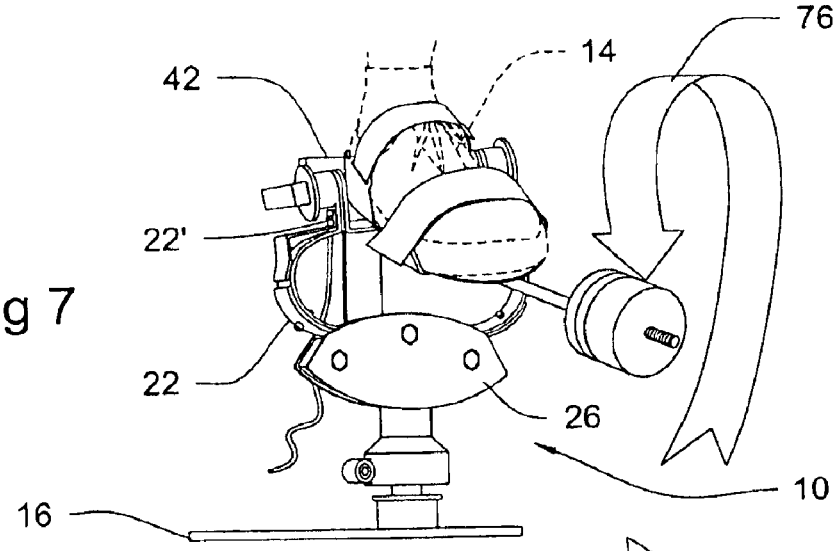
Figure 8:
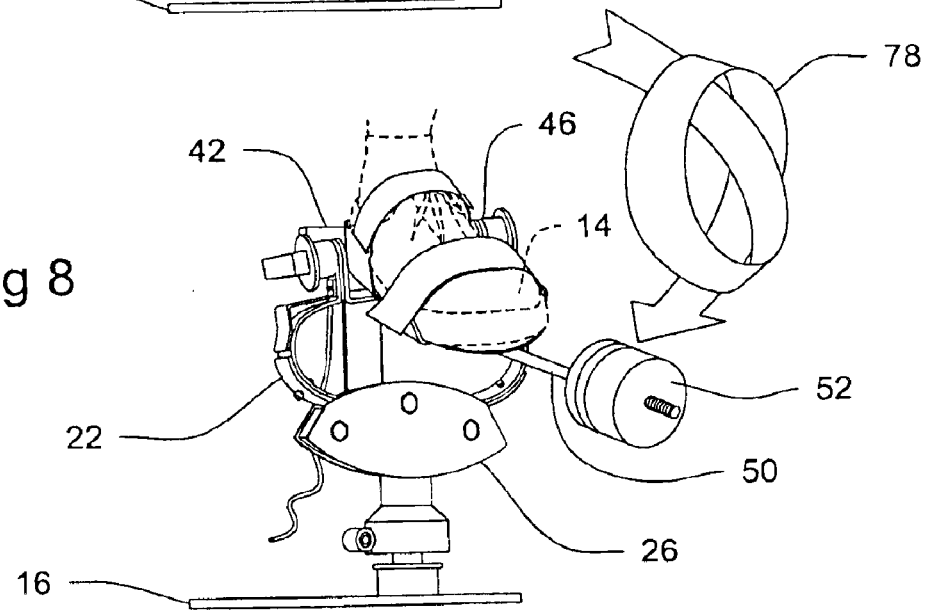

With reference to the accompanying Figures, the exercise assembly of the present invention is generally indicated as 10 and includes a platform 12, having an elongated configuration and being otherwise sufficiently dimensioned and configured to receive and at least partially support a foot of the user, generally indicated as 14, thereon. The exercise assembly 10 further includes a base, generally indicated as 16, which may serve as a support or like structure, and which is designed to support the remainder of the exercise assembly 10 on an appropriate, substantially horizontal surface. Alternatively, the base 16 may include a plurality of rollers, wheels, etc. (not shown for purposes of clarity) so as to allow movement of the base 16 relative to the surface on which it is positioned. Another embodiment of the base 16 includes applicable structure associated therewith which allows it to be selectively positioned along the length of a track assembly. The track assembly comprises one or more elongated tracks generally indicated as 18 and shown in FIG. 1.

The platform 12 is movably interconnected and supported on the base 16 by means of a support assembly 20. The support assembly 20 preferably includes a support structure preferably comprising a single one piece member formed of steel or like material and including two segments 22 and 24. Each of the segments 22 and 24 have corresponding proximal ends integrally or otherwise fixedly secured to one another to define a semi-circular configuration. A mid-portion of the support member 20 is secured to an interconnecting yoke 26. The opposite or distal ends 22' and 24' of each of the support segments 22 and 24 are secured in spaced, substantially opposing relation to one another, as they are attached to opposite sides of the platform 12. By virtue of this structural configuration, the platform 12 is disposed in an upwardly suspended position relative to the base 16. The support assembly including the support segments 22 and 24 are preferably formed from a high strength, light weight steel or like material and may or may not be at least partially flexible. Accordingly, when the foot 14 of the user is secured to the platform 12 while it is being directed through one or more of the aforementioned paths of movement, a substantially downward force may be directed onto the exercise assembly 10, by the user's foot 14. Such force is effectively absorbed by the it support assembly 20, generally, and by the one piece, integrally secured support segments 22 and 24, specifically. It should be apparent therefore that the platform 12, with the foot of the user 14 attached thereto, may or may not "flex" both towards and away from the base 16 during the forced or directed movement of the platform 12 with the foot 14 attached thereto.

The exercise assembly 10 of the present invention also comprises a coupling mechanism, generally indicated as 30, which is connected to the base 16 and extends outwardly therefrom. The coupling mechanism 30 preferably comprises an appropriate mechanical coupling and/or linkage which allows the platform 12 to "universally" move relative to the base 16, as will be described in greater detail hereinafter. A coupling member 36 and supporting shaft 38 serves to interconnect and support the coupling mechanism 30 relative to the lower housing 34, such that the coupling member 36 is connected to the support assembly 20, generally and to the middle or yoke portion 26, specifically, which, as set forth above, is attached to the segments 22 and 24 of the support assembly 20. Movement of the platform 12 through the various paths of movement, to be described in greater detail hereinafter, is preferably accomplished by manual force generated by the user of the device. Such manual force in turn causes the coupling member 36, as well as the support assembly 20, to move with the platform 12. The universal movement of the platform 12 and its range of motion may be varied. Also the actual range of motion of the platform 12 may be extended beyond the "normal" range of the motion of each of the effected joints or body parts being exercise or strengthened.

Figure 9:
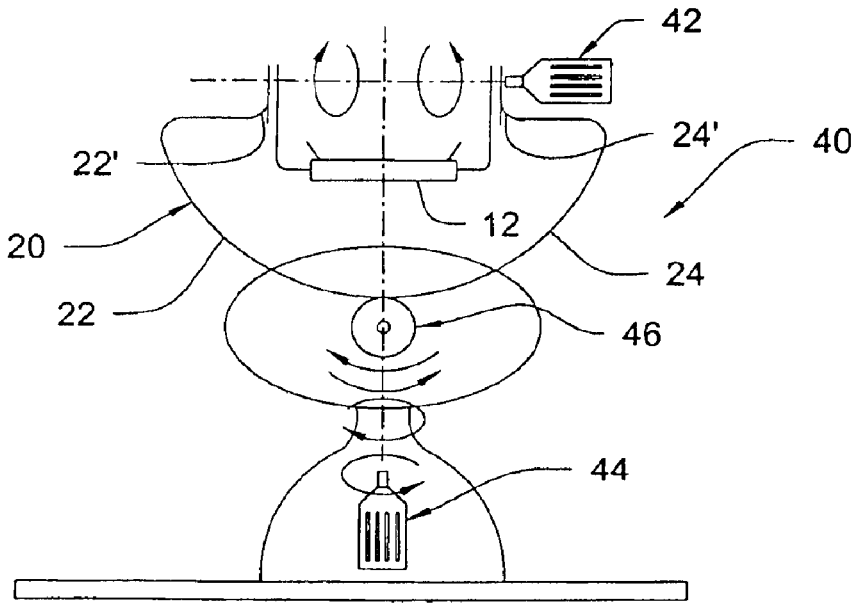
FIG. 9 is a schematic representation of the various components of the exercise assembly of the present invention relative to the orthogonally disposed axes of rotation.
Figure 10:
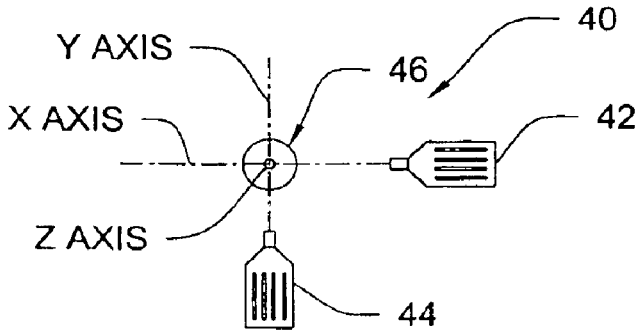
FIG. 10 is a schematic representation of the three orthogonal axes of rotation incorporating a drive assembly which forces the exercise assembly through a predetermined or prescribed path of movements.

While one preferred embodiment of the present invention provides manual force to the platform, thereby allowing the user to move the platform through the predetermined or desired paths of movements as set forth above, another embodiment of the present invention includes a drive assembly which is generally indicated as 40. The drive assembly includes at least one but preferably a plurality of electrically powered drive motors 42, 44, 46, etc. The actual number of drive motors 42, 44, 46, etc. may vary but in at least one preferred embodiment of the present invention, when such drive motors are utilized, at least one is provided to facilitate rotation about each of the aforementioned orthogonally disposed rotational axes. More specifically, the one or more drive motors 42, 44, 46 are individually or collectively coupled by conductors 33 to a power source, such as but not limited to power source 94 in FIG. 11. As schematically represented in FIGS. 9 and 10 the drive assembly 40 may serve to regulate movement of the platform 12 about each of the intended axes of rotation concurrently or independently of one another, wherein such orthogonal axes comprise the x axis, y axis and z axis, as indicated. By way of example and a with reference to FIGS. 9 and 10, each of the individual drive motors 42, 44, 46, may be disposed and structured to regulate travel or movement of the platform 12 relative to a particular one of the x, y, or z axes of rotation. It should be noted, however, that the paths of movement of the platform are not limited to specific and independent rotational movement relative to the aforementioned orthogonal axes but may involve a more complex movement of the platform. Further, and as will be explained with reference to FIG. 11, the plurality of drive motors 42, 44, 46 may be pre-programed or otherwise controlled so as to duplicate a path of movement which has been previously stored and programed into a processor 100 associated with a sensor assembly, to be described hereinafter. Therefore, activation of the plurality of drive motors 42, 44, 46 in combination with a pre-programing or responsive, operative interconnection to the processor 100, serves to regulate movement of the platform 12 by periodic and/or sequential activation of the various drive motors 42, 44, and 46. Any of an almost infinite variation and number of paths of movement may be accomplished through activation of the drive assembly 40. Also, the range of motion of the platform 12 is concurrently regulated as it is being directed through each of the paths of movement.

As related the term "range of motion" may be more precisely defined by the actual length or degree of travel through which the platform 12, and the foot attached thereto, are directed by 11, the cooperative structuring and operation of the drive assembly 40 with other of the components of the exercise assembly 10 of the present invention, as set forth herein. Regulating and/or determination in terms of pre-programing or pre-setting the various components of the exercise assembly 10 of the present invention may serve to predetermine and regulate particular paths of movement as well as the aforementioned range of motion demonstrated by the platform 12. Further, as also set forth herein the actual range of motion may be somewhat extended beyond what is considered to be a normal range of motion of each of the individual body portions of joints, including the foot, ankle, knee, lower leg, thigh, etc. in order that the "normal" range be expanded.

Further with regard to FIGS. 9 and 10 the schematic representation shown therein further emphasizes the orthogonally oriented axes of rotation and also the plurality of drive motors 42, 44, and 46 which control rotation or the various paths of movement which the platform 12 may assume upon activation of the various motors 42, 44 and 46. As clearly set forth in these Figures and described in detail above, the respective drive motors 42, 44, and 46 may or may not be interconnected and/or may be individually and/or collectively responsible for rotating the platform about the various x axes, y axes and z axes.

Figure 11:
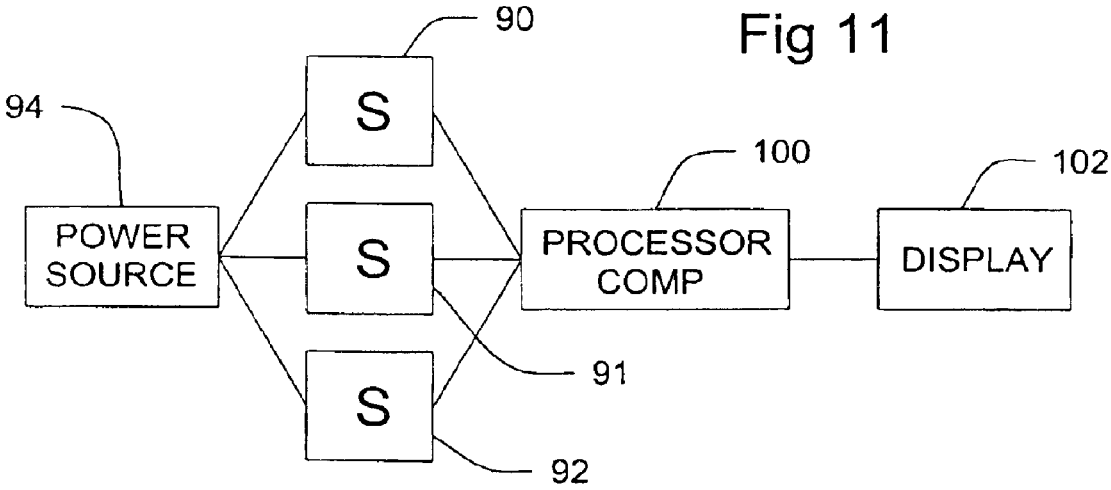
FIG. 11 is a schematic representation of a sensor assembly used in combination with processor/computer and/or display facility for informing the user of the path and range movements on a real time basis.

As disclosed in FIG. 11, another feature of at least one embodiment of the present invention may include a sensor assembly including a plurality of preferably electrically powered sensors 90, 91 and 92 each electrically connected to some type of power source 94. The power source 94 may also be used to provide electrical energy to the various drive motors 42, 44, and 46 in the embodiment of FIGS. 9 and 10. In any event the plurality of sensors which may vary in number from one sensor to three or more sensors are strategically interconnected with remaining components of the exercise assembly 10, so as to limit the range of motion and/or the duration of travel and/or rotation of the platform 12 about the various orthogonal axes of rotation or the other paths of movement, as described above. Once this motion, rotation, movement, etc. is sensed the determined data may be sent to a processor or computer assembly 100 for storage and/or processing. The processor/computer 100 may be further structured to be accessed so as to retrieve the stored data received from the plurality of sensors 90, 91, 92, and thereby duplicate any of the large number of paths of movements which may be traveled by the platform and which may be preferred based on the rehabilitation, exercising or strengthening of a given part or parts of the user's body.

Also a display facility 102 may be provided and which is responsive to the data received from the processor/computer 100 for the real time, visual display of the paths of movement that the platform 12 assumes. By virtue of this display facility 102 and its responsive combination with the processor/computer 100, the user may be able to view, on a real time basis, the path or paths of movement of the platform 12, as well as the range of motion of each of the manipulations which may be caused by the user and/or by the plurality of drive motors 42, 44 and 46, as set forth above with either of the embodiment of FIG. 1 or the embodiment of FIGS. 9 and 10.

Yet another structural feature of the exercise assembly 10 of the present invention includes the provision of a weight assembly including at least one weight structure 48. The weight structure 48 includes an elongated connecting arm 50, and at least one or more removably attached weights 52 secured adjacent the outer end of the arm 50. The inner end of the arm 50 is attached directly to the platform 12 and extends outwardly therefrom so as to provide a variable amount of resistance force to the platform 12 and to the foot 14 attached thereto, as the various paths of movement are performed. The amount of resistance is of course dependent, at least in part, on the mass of the weight 52 secured to the arm 50. In addition, the weight assembly may include a plurality of other weight structures 48 located strategically at predetermined, spaced apart locations on the platform 12, such that the aforementioned resistive force applied to the platform 12 may further facilitate the exercise and development of the predetermined portions of the individuals body. It is acknowledged that the effect of the one or more weight structures 48, as described above, may be of maximum or more significant benefit when the preferred embodiment of the exercise assembly is utilized, and the manual force supplied by the user is that force which facilitates the movement of the platform. This of course is in contrast to the above described embodiment shown in FIGS. 9 and 10 wherein a plurality of drive motor 42, 44, and 46 are utilized as described. However, it is also contemplated that the existence of a plurality of the weight structures 48 in spaced apart location relative to the platform 12 and being affixed thereto can provide sufficient resistence to exercise and strengthened indicated and preferred parts of the users body, in either of the above noted embodiments of the present invention.

With reference to FIGS. 1, and 6 through 8, a plurality of individual paths of movement are schematically represented by directional arrows 72, 74, 76 and 78, as respectively demonstrated in the above noted Figures. It is emphasized that the directional arrow 72, 74, 76 and 78 are each intended to represent one of a larger number of paths of movement through which the platform 12 and foot 14 of a user may travel. Naturally, these paths of movement are meant to be representative only of a much larger number of possible paths through which the platform 12 and foot 14 may be directed to travel in order to facilitate exercise, strengthening and/or rehabilitation of the individual parts or predetermined portions of the foot, ankle and lower leg, as well as the various muscle groups and other body parts associated therewith. Further, each of the paths of travel 72, 74, 76 and 78, as well as the other possible paths of travel not represented, may be performed on a continuously repetitive basis in order to fully exercise a particular portion of the user's body on which a particular path of movement is designed to concentrate.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An exercise assembly structured to exercise a leg-ankle-foot portion of a user's body, said exercise assembly comprising:

a) a platform dimensioned and configured to support a foot of the user thereon, b) a base innerconnected in supporting relation to said platform, c) a support assembly including a support structure having a curvilinear length and a substantially semi-circular configuration, d) said support structure having opposite free ends each connected to said platform and a mid-portion of said curvilinear length movably connected to said base, e) said support structure disposed and dimensioned relative to said base and said platform to substantially align a diameter of said semicircular configuration of said support structure with a true center of articulation of the ankle joint, f) said platform manually driven by force exerted thereon by the user, and g) said platform and said support structure cooperatively structured to direct the platform through a plurality of axes of rotation collectively defining a plurality of paths of movement.

2. An assembly as recited in claim 1 wherein said plurality of axes of rotation at least partially correspond to the natural axes of rotation of the ankle, lower leg and knee.

3. An assembly as recited in claim 1 further comprising a coupling mechanism movably innerconnecting said mid-portion of said curvilinear length to said base.

4. An assembly as recited in claim 3 further comprising a yoke disposed on said support structure substantially at said mid-portion of said curvilinear length, said coupling mechanism interconnected to said support structure by said yoke.

5. An assembly as recited in claim 4 wherein said coupling mechanism and said support structure are cooperatively disposed and structured to facilitate at least partial universal movement of said platform relative to said base.

6. An assembly as recited in claim 1 wherein said support structure is disposed and configured to substantially align a diameter thereof in substantially coextensive relation with the anti-posterior axis of the ankle.

7. An assembly as recited in claim 1 wherein said support structure is rotational relative to said base in a substantially horizontal plane.

* * * * *